US008138457B2

(12) United States Patent
Seo

(10) Patent No.: US 8,138,457 B2
(45) Date of Patent: Mar. 20, 2012

(54) PLATE-TYPE HEATER AND A METHOD FOR THE MANUFACTURE THEREOF

(75) Inventor: Tae Suk Seo, Seoul (KR)

(73) Assignee: Carbonic Heat Corporation, Commerce, CA (US)

( * ) Notice: Subject to any disclaimer, the term of this patent is extended or adjusted under 35 U.S.C. 154(b) by 901 days.

(21) Appl. No.: 11/995,226

(22) PCT Filed: Jul. 7, 2006

(86) PCT No.: PCT/US2006/026639

§ 371 (c)(1),
(2), (4) Date: Jan. 10, 2008

(87) PCT Pub. No.: WO2007/008734

PCT Pub. Date: Jan. 18, 2007

(65) Prior Publication Data

US 2008/0264929 A1 Oct. 30, 2008

(30) Foreign Application Priority Data

Jul. 12, 2005 (KR) ..... 10-2005-0062812

(51) Int. Cl.
*H05B 3/10* (2006.01)
*H05B 11/00* (2006.01)

(52) U.S. Cl. ..... 219/548; 219/211; 219/212; 219/213; 219/217; 219/527; 219/528; 219/529; 219/549

(58) Field of Classification Search ..... 219/211–3, 219/217, 527–9, 548–9
See application file for complete search history.

(56) References Cited

U.S. PATENT DOCUMENTS

| | | | | |
|---|---|---|---|---|
| 3,839,134 | A | 10/1974 | Fujihara | |
| 5,004,895 | A * | 4/1991 | Nishino et al. | 219/528 |
| 2001/0014212 | A1 * | 8/2001 | Rutherford | 392/503 |

FOREIGN PATENT DOCUMENTS

| | | | |
|---|---|---|---|
| CN | 1409941 | | 6/2001 |
| CN | 1409941 | | 4/2003 |
| EP | 0409393 | * | 1/1991 |
| EP | 0409393 | A2 | 1/1991 |

OTHER PUBLICATIONS

European Patent Office, Supplementary European Search Report for EP 06786703, Feb. 11, 2010, 7 pages.

* cited by examiner

*Primary Examiner* — Shawntina Fuqua
(74) *Attorney, Agent, or Firm* — Sanford Astor; Lewis Brisbois Bisgaard & Smith LLP

(57) ABSTRACT

The present invention provides a plate-type heater designed to allow uniform generation of heat across the entire surface of the heater, comprising an upper component composed of a first outer covering and a first intermediate layer joined together and a lower component composed of a second outer covering and a second intermediate layer joined together, with a heating element being placed between said upper component and lower component and wires laminated onto the two end surfaces of said heating element.

11 Claims, 3 Drawing Sheets

PLATE-TYPE HEATER AND A METHOD FOR THE MANUFACTURE THEREOF

TECHNOLOGICAL FIELD

The present invention concerns a heater, and more specifically, a plate-type heater and a method for its manufacture.

BACKGROUND ART

Conventional plate-type heaters, which generate heat when electricity is applied to them, are not only clean and do not cause air pollution, but their temperature can easily be adjusted and they are noise-free. They are therefore widely used in mats and beds, bed mattresses, electric quilts and blankets, and heating devices for residential use in apartments, general residential dwellings, etc. Moreover, they are also used in heaters for commercial buildings such as offices and stores, industrial heaters for workshops, warehouses, and barracks, and in various other heaters for industrial use, agricultural equipment such as greenhouses and drying systems for agricultural products, and various anti-freezing systems, such as devices for melting snow and prevention of freezing in streets and parking structures. They also have applications for recreational use, protection against cold, household electrical appliances, devices for preventing steam formation on mirrors and glass, health care, animal husbandry, etc.

FIG. 1 is a diagram showing the structure of a plate-type heater according to the prior art. Referring to FIG. 1, the heater essentially consists of multiple ladder-shaped heating lines (11) configured at regular intervals by means of which heating takes place (11). Current-carrying films (12) at either end of the heating lines (11) supply electricity, and transparent film (13) covers all of the heating lines (11) and the current-carrying films (12). In this case, the transparent film (13) is configured in such a way as to cover both the top and bottom parts of the heating lines (11) and the current-carrying film (12).

In the prior art device of FIG. 1, the heating lines (11) are made of carbon, and the current-carrying film (12) is provided in the form of a thin film made of copper or silver. The current-carrying film (12) and heating lines (11) are attached to each other using a conductive adhesive. The transparent film (13) is made of polyethylene (PET).

The manufacturing method of the plate-type heater shown in FIG. 1 is as follows.

First, a printer using conductive ink (the heating material) is used to print the heating lines (11), which are configured in a ladder pattern, on the transparent PET film.

Next, a conductive adhesive is used to attach the thin current-carrying film (12) made of copper or silver in such a way that the ends of the adjacent heating lines (11) are connected.

After this, a transparent film (13) is attached to the surface of the heating lines (11) and the current-carrying film (12) using a dry lamination method, specifically an adhesion-bonding method.

In the embodiment of the plate-type heater shown in FIG. 1, the heater is configured in such a way that heat is generated by the heating lines (11) configured in a ladder pattern. However, the plate-type heaters of prior art essentially have the form of line-type heaters, rather than plate-type heaters that provide all-surface heating. Specifically, heat is generated only in heating lines (11) to which heating material is applied, rather than generating heat throughout the entire surface of the heater.

Therefore, heaters in which heat is generated only in the heating lines (11) have the drawback of a sharply decreased heating effect.

Moreover, in the prior art, because of limitations on the electrical resistor itself in the current-carrying film and concerns about the phenomenon of rapid carbonization of the conductive adhesive used in the current-carrying film (12), it has not been possible to generate temperatures of 50° C. or above in the heating areas or to use such heating devices for long periods. Accordingly, in heaters of the prior art, it is preferable to use thicker wire cut to sections of approximately 1 meter or less, connected by soldering or adhesion in order to connect the heating elements to one another.

In the prior art, moreover, as conduction of electricity and heating were only possible in the areas on which the heating elements were printed, it was necessary to generate relatively high temperatures to transmit heat throughout the entire device, resulting in overloading of the current-carrying areas and the current-carrying film. Accordingly, because of the phenomenon of carbonization of the conductive adhesive used on the current-carrying film, there is a rapid decrease in functioning and there is a high risk of fire resulting from heating of the current-carrying film or conductive printed component.

Moreover, in the prior art, connection must be carried out using thick wires cut to specified lengths (approximately 40 cm-100 cm) or more, which makes connection extremely complex in large-area construction projects, such as laying tile on cement, thus requiring a great deal of manpower.

In the prior art, moreover, as far infrared rays are emitted only in the conductive printed areas, the actual amount of radiation with respect to the entire area to be heated is reduced by half. When the method of prior art is used as is, as the areas in which heat is, and is not, generated are clearly separated, this makes uniform heating unachievable, and it is therefore necessary to cover the heating element with a thermal conductor that can reliably conduct heat. Also, as there is no way to process the induced current generated on the heating element, the problem of damage caused by static electricity must be tolerated. In addition, as the current-carrying plate is large in area, it generates a relatively large amount of electromagnetic waves.

Finally, attempts to fix the current-carrying film in place using an adhesive, require using a film that is as thick as possible, because of this adhesion.

OBJECT OF THE INVENTION

The object of the present invention is to solve the problems of the prior art discussed above, by providing a plate-type heater in which heat can be uniformly generated throughout the entire surface of the heater and a method for its manufacture.

DISCLOSURE OF THE INVENTION

The following is an explanation of the present invention referring to the attached figures, which show preferred working examples of the present invention, in order to explain the invention in sufficient detail so that a person possessing general knowledge in the technological field of the invention can use the technical information presented herein to easily practice the invention.

In the following, an all-surface plate-type heater in which heat is generated throughout the surface is disclosed, in contrast to plate-type heaters having a line-type heating element configuration.

In order to achieve the above purpose, the plate-type heater of the present invention comprises an upper component composed of a first outer covering and a first intermediate layer joined together and a lower component composed of a second outer covering and a second intermediate layer joined together, with a heating element being placed between said upper component and lower component and wires being laminated onto the surfaces of said heating element.

The method for manufacturing the plate-type heater of the present invention comprises a step in which an upper component and a lower component composed of joined outer coverings and intermediate layers are manufactured, a step in which a heating element is applied to the upper part of the entire surface of the aforementioned lower component, and a step in which conductive wires used to supply electrical energy are attached by lamination to the ends of the aforementioned heating element, and the aforementioned lower component to which the heating element has been applied and the aforementioned upper component are joined.

EXPLANATION OF NUMBERS REFERRING TO THE MAIN COMPONENTS OF THE INVENTION

Figure 1:
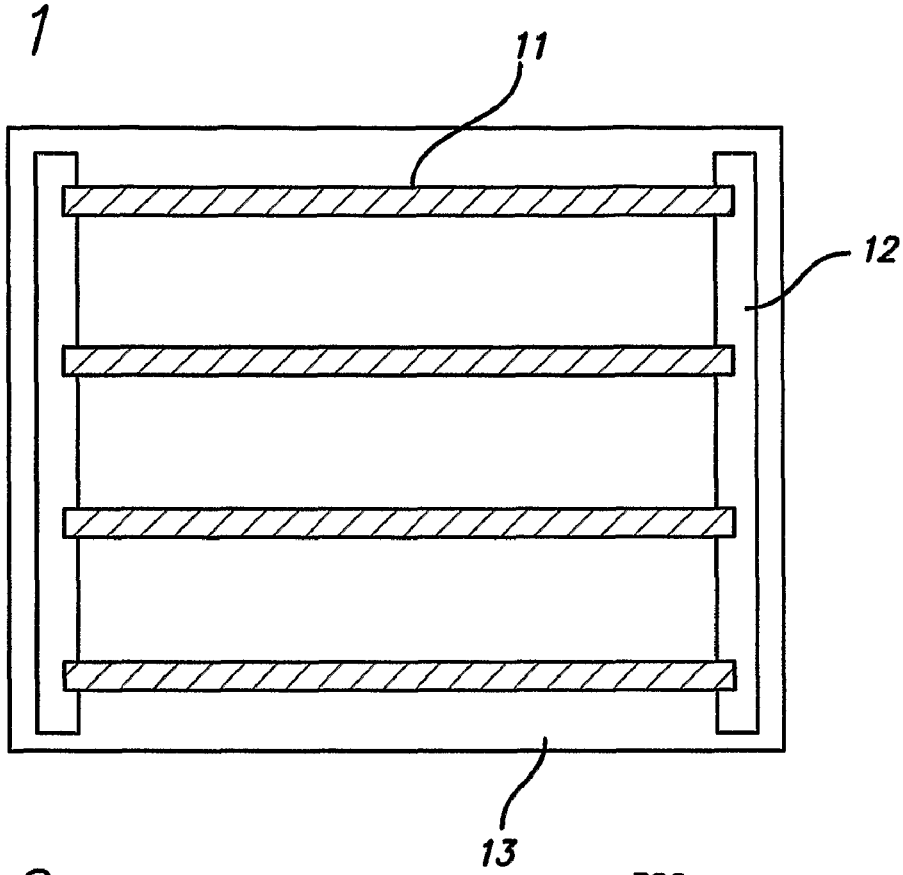
FIG. 1 is a diagram showing the structure of a plate-type heater of prior art.

100: Upper component
101:First outer covering
102:First intermediate layer
200:Lower component
201:Second outer covering
202:Second intermediate layer
300:Carbon compound
400:wire

DETAILED DESCRIPTION OF THE INVENTION

Figure 2:
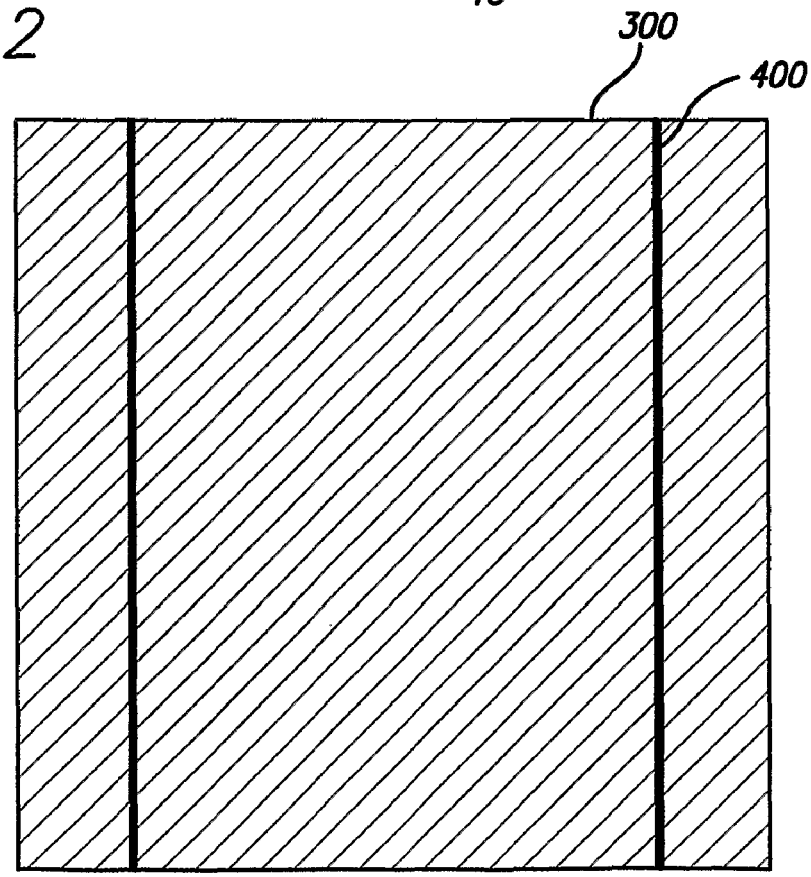
FIG. 2 is a diagram showing a plan view of a plate-type heater according to a working example of the present invention.
Figure 3A:
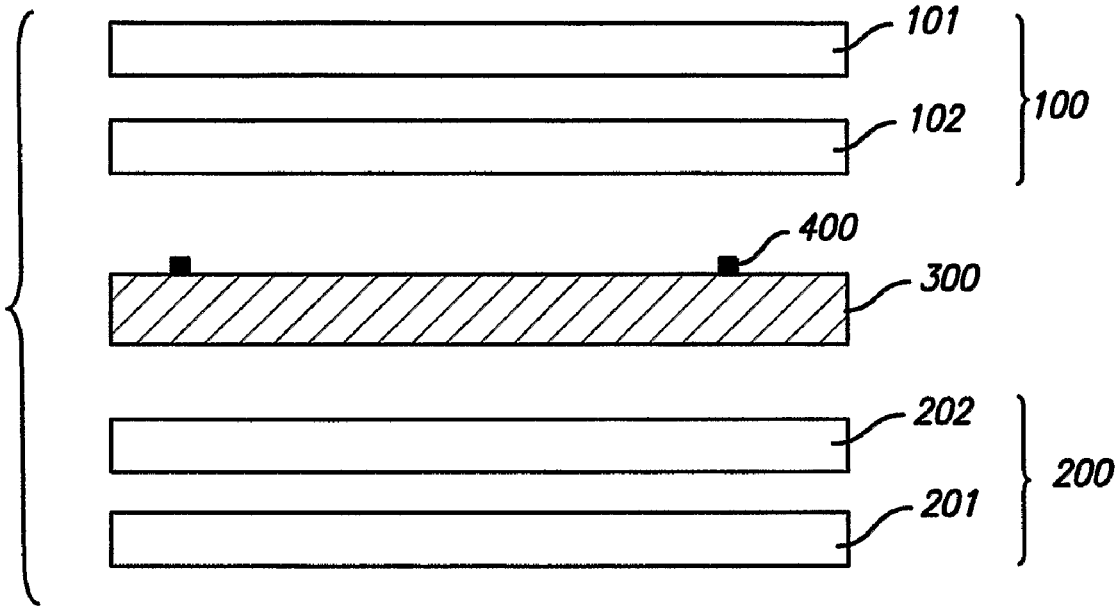
FIG. 3*a* is a diagram showing the structure of a plate-type heater according to a working example of the present invention.
Figure 3B:
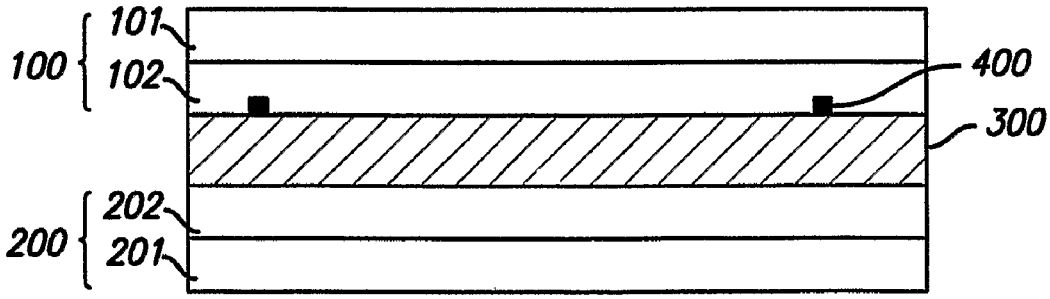
FIG. 3*b* is a final manufacturing completion diagram showing a plate-type heater of the present invention; and, FIG. 4 is a diagram showing an application example of a plate-type heater according to a working example of the present invention.

FIG. 2 shows a plan view of a plate-type heater according to a working example of the present invention, FIG. 3*a* is a diagram showing the structure of the plate-type heater, and FIG. 3*b* is a final manufacturing completion diagram of the plate-type heater.

The following is an explanation with reference to FIGS. 2, 3*a*, and 3*b*.

The plate-type heater according to the working examples of the present invention comprises an upper component (100) comprising a first outer covering (101) and a first intermediate layer (102) joined together, a lower component (200) composed of a second outer covering (201) and a second intermediate layer (202) joined together, a carbon compound (300) placed between the upper component (100) and the lower component (200), and wires (400) fusion-bonded to the surface of the heat-generating layer (300).

In this case, the carbon compound (300) converts electrical energy to thermal energy, thus emitting far infrared rays.

Moreover, the first intermediate layer (102) and the second intermediate layer (202) act as the primary components blocking electricity from the heat-generating carbon compound (300) and maintaining the original shape of the device, thus constituting a kind of insulating material for improving printing of the carbon compound (300).

On the other hand, the first outer covering (101) and the second outer covering (201) act as the secondary components blocking electricity coming from the carbon compound (300) and maintaining the original shape of the device, and they form an outer covering of polyolefin class material whose surface is printable.

Finally, wires (400) are fixed in place on the current-carrying film (current-carrying wire) solely by lamination without using an adhesive. Wires (400) may be flat strips of a conductive material, such as copper or may be braided wires which are pressed to a substantially flat shape.

In the method for manufacturing the plate-type heater of this invention, first, the upper component (100) composed of the first outer covering (101) and the first intermediate layer (102) and the lower component (200) composed of the second outer covering (201) and the second intermediate layer (202) are manufactured. In this case, the first outer covering (101) and second outer covering (201) on the one hand and the first intermediate layer (102) and second intermediate layer (202) on the other, which make up the upper and lower components respectively, are composed of the same materials, so in the following explanation, only the first outer covering and first intermediate layer are described.

In the first outer covering (101), taking into account heat resistance and heat retention properties and dimensional stability, resin films composed of polyethylene (PET), polypropylene (PP), nylon, or similar materials which show no deformation at temperatures of 150° C. or below, are selected as films because of their durability, heat resistance, transparency, printing properties, etc. These films are used as the outer covering of the outermost portion of the plate-type heater, and it is possible to print logos and advertising slogans on the back of these films.

Moreover, the second intermediate layer (102) is not found in conventional plate-type heaters or line-type heaters. In conventional plate-type heaters or line heaters, the outer covering film is directly attached to the heat-generating layer without an intermediate layer using an adhesive (dry laminating), causing numerous problems with respect to the insulating and heat retention properties of the heater itself and resulting in quite severe problems with stability, and because of these problems with electrical stability, there is a constant risk of fire.

In order to remedy these flaws, enhance electrical insulating properties and heat retention properties, and increase stability in consideration of the problems connected with existing dry lamination methods, non-woven fabrics, such as polyethylene, polypropylene, paper or cotton fabrics are selected for use as the first intermediate layer (102). These materials usually are used in a width of about 50 cm to about 200 cm, and must show no deformation at temperatures of 150° C.

As mentioned above, the first outer covering (101) and the first intermediate layer (102) are joined to manufacture the upper component (100), with the resin used for joining being a polyolefin resin having a melting point of 100° C.-170° C., and the resin is melted at 300° C. and extrusion coating is carried out individually, or in combination, to join and manufacture the upper component (100).

Using the method described above, the lower component (200) is then joined and manufactured from the second outer covering (201) and the second intermediate layer (202).

On the other hand, the extrusion coating method used in joining the outer covering and the intermediate layer (extrusion laminating) differs completely from the method of dry laminating used in the prior art for adhesion, in manufacturing of all plate-type heaters or line-type heaters.

As mentioned above, after manufacturing the upper component (100), which is composed of the outermost covering (101) and the intermediate layer (102) and which may have company logos or slogans printed on its surface, and the lower component (200), which is spread on the ground during use and bears no slogan whatsoever, a carbon compound material (in hardened form) is placed on the surface of the lower component (200), and a second carbon compound (300), in consideration of its conductivity and heat generation properties, is laminated on by means of gravure printing in accordance with the requirement that the mesh size of the gravure printing roller must be 80#-150#, and the width of the mesh printing surface is adjusted to 50 cm-200 cm so as to conform to the heating width.

The printing method conventionally used in manufacturing heaters has been the screen printing method, and because lamination printing is impossible by the screen printing method, high-viscosity ink is used, and after printing by the screen printing method, the outermost covering was attached by the dry lamination method. However, the degree of conductivity and the amount of heat must be adjusted by means of viscosity, and it is very difficult to carry out such adjustments in a precise manner. Accordingly, the type of product manufactured can only be simple.

If the gravure printing method is used in order to compensate for this, as is the case in the present invention, the concentration of the carbon composite compound (300) and the thickness of the laminate must be taken into consideration, and single or multiple lamination can be carried out in accordance with customer requirements and the application in question. More precise adjustments can be made by adjusting the mesh size of the printing roller. An important factor in this case is that with a size of 80 mesh or below, the ink will blot, making precise product manufacturing difficult, while at a mesh size of 150 or above, the ink will not provide sufficient coverage, making it impossible to manufacture the product. Accordingly, in the gravure printing method of the present invention, manufacturing must be carried out in all cases with a mesh size of 80#-150#. This is done so that it is possible to adjust the conductivity and amount of heat as needed under any conditions.

As discussed above, once manufacturing is completed of the upper component (100) and the lower component (200), to which the carbon compound (300) is applied, the upper component (100) and the lower component (200) are joined to complete the plate-type heater, and a copper plate finished product, optionally having holes drilled in it for burying current-carrying electric wire or current-carrying braided wires (400) having an overall diameter of 2 to 3 mm, or more, preferably 2-2.3 mm, composed of 10 or more strands of thin twisted copper wire, which are attached at the ends, or if necessary in the middle, of the laminated carbon compound (300), melted with the used polyolefin resin, and joined and completed by the extrusion lamination method.

In the present invention, in order to solve the drawback of existing plate (line) type heaters, namely problems resulting from adhesion to the current-carrying film using a conductive adhesive, wires (400) are fixed in place solely by lamination, without using an adhesive, and for this purpose, electric wire having an overall diameter of about 2 to about 3 mm or more (flat strip wire or braided (twisted) thin wire) is processed to compress it into as flat a shape as possible and then used. It is processed into a flat shape in order to make the surface adhering to the application surface of the carbon compound (300) wide, or during manufacturing, to reduce to a minimum any areas protruding from the surface in order to maintain an aesthetically pleasing appearance.

As discussed above, overall width can be adjusted depending on the application in question. Specifically, by adjusting the thickness of the wires (400), a product can be manufactured having a minimum construction width of 1 meter or more (up to 100 meters or more) without cutting.

Although the width of the plate-type heater must be large, if it is used in cases where high temperature is required, wire having a larger thickness may be used. Either alternating current (AC) or direct current (DC) can be used as a working voltage, with a voltage range of 6 V to 400 V being preferred. Furthermore, conductivity is $0\text{-}10^2$, electrical resistance is 0-900Ω, the application thickness of the carbon compound is 10-100 μm, the heat-generating width is 50-200 cm, and the far infrared radiation percentage is 87.5%.

The approximate composition of the carbon compound (far infrared radiation conductive ink) of the plate-type heater of the present invention is 30.4% urethane polymer resin, 15.6% conductive powder (such as a carbon polymer), 4% additives (such as an adhesive), and 50% dilute solvent (such as water or a thinner).

Figure 4:
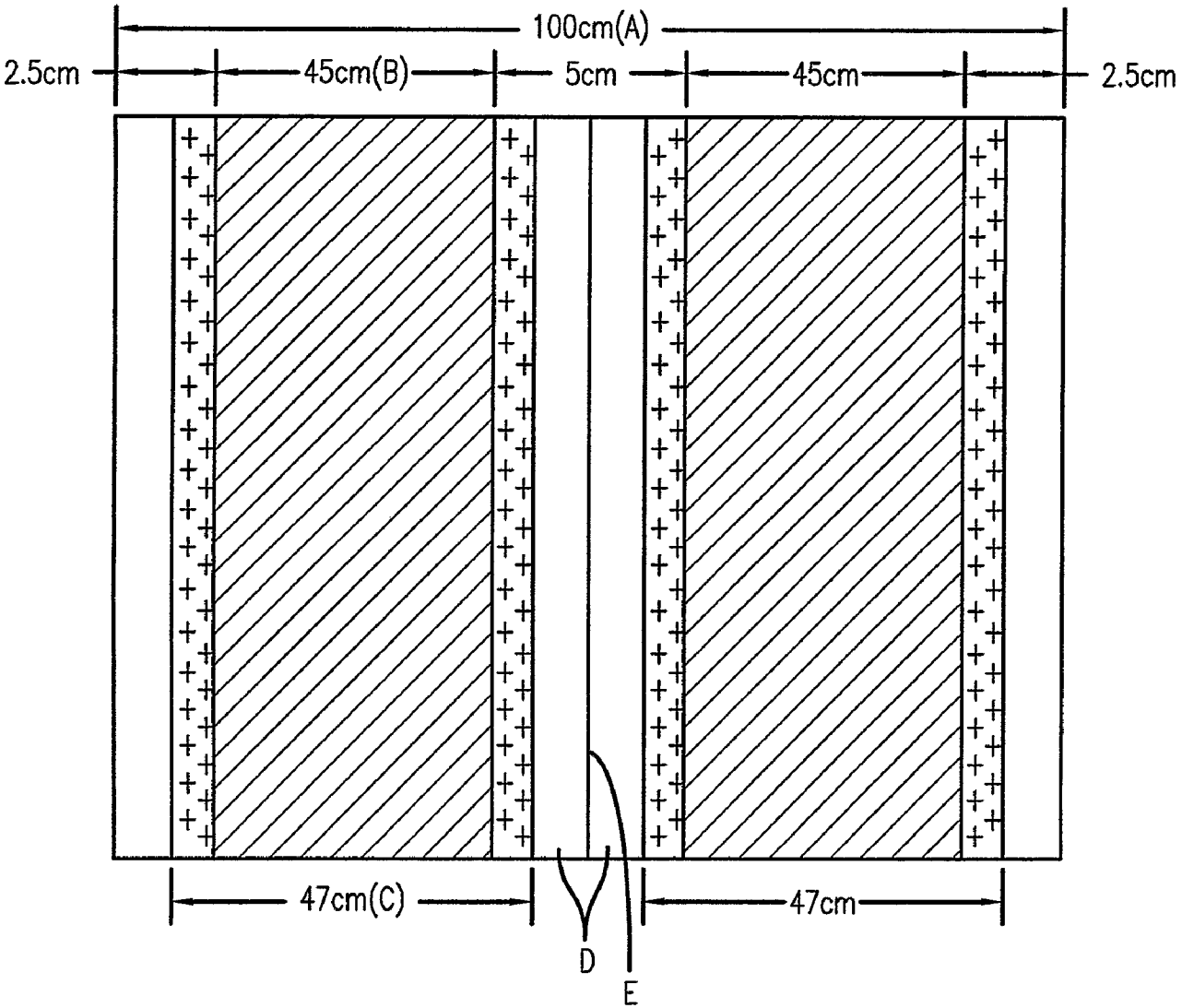

FIG. 4 shows an application example of the plate-type heater according to a working example of the present invention. Other sizes may be manufactured as set forth herein.

As shown in FIG. 4, if the total width (A) of the plate-type heater is 100 cm, and the portion that generates heat when current is applied (B) is 45 cm, and the part that does not generate heat when current is applied (C) is 47 cm, it gives a width for the remaining portion (D), which neither carries current nor generates heat, of 1.5 cm.

In cases where only half of the entire width is required, the product can be cut in the middle (E) and used, with this posing no problems whatsoever from an electrical standpoint.

In the present invention, as stated above, as current and heat are easily generated throughout the entire surface, in comparison to line-type heaters, the entire surface can be evenly heated using half the amount of heat, so there is no waste whatsoever, and the wire, which is the current-carrying area, can be manufactured with a thin thickness as required by the application and the surface area in question.

In addition, as no adhesive is used on the wire, the possibility of occurrence of the phenomenon of carbonization becomes lower with the passage of time, and as it is possible to adjust the thickness of the wires, there is no risk of fire resulting from heating.

Because the invention can be used without requiring cutting or connecting, operation is simple and easy, and compared to line-type heaters, the heat and far infrared radiation generated can be increased by a factor of approximately 2 based on total surface area.

Moreover, as other thermoelectric conductors are not required, it is possible to use the invention, as is, in floors covered with laminated paper, and in cases where induced current is generated on the heater, this current can be completely eliminated by using shielding and grounding the device.

Generation of electromagnetic waves is also relatively low, and the carbon compound absorbs electromagnetic waves with virtually no damage.

As polyolefin resin is used rather than an adhesive in extrusion lamination, the thickness of the current-carrying copper film can be selected based on the application and requirements in question, and large-width products can also be manufactured (with widths up to 5 times greater than those shown by line-type heaters of the prior art).

The carbon in the carbon compound used in the plate-type heater of the present invention is known to have numerous applications and properties, providing the advantages not only of heat, but also of far infrared radiation, with effects such as absorption of electromagnetic waves, deodorization, adsorption of heavy metals, generation of far infrared radiation, adjustment of humidity, elimination of bacteria, prevention of the effects of agricultural chemicals and acidification, and the production of anions.

When carbon is used as a heat-generating substance as described above, weak electrical energy can be used to obtain a high amount of heat via the intermediary of an electrically resistant heating element, thus allowing use in future-oriented energy applications. For example, the invention can be applied in areas such as cultivating rice and vegetable seedlings, etc., drying (bactericidal action of far infrared drying and 80% restoration of the original form on rehumidification after drying), mushroom cultivation, animal husbandry, bedding (health beds and floor cushions), construction (heating materials), and food products (home food processing of roasted meat and fish), etc.

Table 1 below shows a comparative table of energy consumption according to individual heating materials in use of a plate-type heater according to a working example of the present invention.

TABLE 1

| | Late-night power consumption | Electric panel | City gas | Boiler | LPG | Plate-type heater |
|---|---|---|---|---|---|---|
| Heating cost per pyong[1] | 5,998[2] | 11,456 | 6,500 | 11,050 | 11,400 | 4,754 |
| Monthly consumption | 102 kw | 167 kw | 13 $m^3$ | 17 Liters | 12 kg | 69.3 kw |

[1]One pyong is equivalent to 3.954 square yards.
[2]In Korean won

The above table is based on operation 8 hours per day for a period of 30 days, with the external temperature being kept at 0° C. and the inside temperature at 22° C.

As can be seen from Table 1, in the case of use of the plate-type heater, the heating cost per pyong can be markedly decreased, and compared to monthly late-night power consumption using the same units, a decrease of almost half can be achieved.

Specific explanations of the technical concept of the present invention have been given according to preferred working examples, but it should be noted that the above working examples were given solely by way of explanation and by no means limit the present invention. Moreover, a person skilled in the art in the field of the present invention understands that numerous working examples are possible within the scope of the technical concept of the present invention.

As the present invention provides a plate-type heater having an all-surface heater structure, it has the effect of making it possible to increase the amount of heat or far infrared radiation generated.

Moreover, as the present invention involves attachment of a current-carrying film by the extrusion lamination method rather than using the adhesive method, this has the effect of making it possible to manufacture products having a large width.

INDUSTRIAL APPLICABILITY

The plate-type heater of this invention are widely used in mats and beds, bed mattresses, electric quilts and blankets, and heating devices for residential use in apartments, general residential dwellings, etc. Moreover, they are also used in heaters for commercial buildings such as offices and stores, industrial heaters for workshops, warehouses, and barracks, and in various other heaters for industrial use, agricultural equipment such as greenhouses and drying systems for agricultural products, and various anti-freezing systems, such as devices for melting snow and prevention of freezing in streets and parking structures. They also have applications for recreational use, protection against cold, household electrical appliances, devices for preventing steam formation on mirrors and glass, health care and animal husbandry.

Having described the invention, I claim:

1. A method for manufacturing a plate-type heater, comprising, manufacturing an upper component and a lower component composed of joined outer coverings and intermediate layers;

applying a heating element to the upper part of the entire surface of the lower component; and attaching wires, used to supply electrical energy, by lamination, to the ends of the heating element, and joining the lower component to which the heating element has been applied, to the upper component, in which the joining of the outer coverings and intermediate layers is carried out by extrusion lamination using a polyolefin resin.

2. The method for manufacturing a plate-type heater according to claim 1, in which the joining of the outer covering and intermediate layer is carried out by extrusion lamination using a polyolefin resin having a melting point of from about 100° C. to about 170° C.

3. The method for manufacturing a plate-type heater according to claim 1 in which the application of the heating element is carried out by gravure lamination printing.

4. The method for manufacturing a plate-type heater according to claim 3, in which the gravure lamination is carried out using a gravure printing roller mesh size of about 80# to about 150#.

5. The method for manufacturing a plate-type heater according to claim 1, in which adhesion of the wires is carried out by fusion bonding with polyolefin resin.

6. The method for manufacturing a plate-type heater according to claim 1, in which the thickness of the wires is adjusted to manufacture products having a width of 1 meter or more without cutting.

7. The method for manufacturing a plate-type heater according to claim 1, in which the lamination process used is extrusion lamination.

8. A plate-type heater, comprising an upper component comprising a first outer covering and a first intermediate layer;

a lower component comprising a second outer covering and second intermediate layer;

said first outer covering and said first intermediate layer joined together by a polyolefin resin using an extrusion coating process;

said second outer covering and said second intermediate layer joined together by a polyolefin resin using an extrusion coating process;

a heating element comprising a first carbon compound layer, in a hardened form, placed between the upper component and the lower component and a second carbon compound layer laminated on the first carbon compound layer by gravure printing;

conductive wires fusion bonded to both ends of the second carbon compound layer by lamination, without an adhesive, so that when electricity is passed to the conductive wire, the entire carbon compound layers are heated.

9. The plate-type heater of claim 8, in which the carbon compound is composed of a mixture of a urethane polymer resin, a conductive powder, additives, and a diluent solvent.

10. The plate-type heater of claim 8, in which the first intermediate layer and second intermediate layer are composed of a non-woven fabric, paper, or cotton.

11. The plate-type heater of claim 8, in which the first outer covering and second outer covering are selected from polyethylene, polypropylene, and nylon.

* * * * *